US008123001B1

(12) United States Patent
Apostolopoulos et al.

(10) Patent No.: US 8,123,001 B1
(45) Date of Patent: Feb. 28, 2012

(54) MODULAR PLATFORM/ SCAFFOLDING

(75) Inventors: Lambros Apostolopoulos, Amherst, NY (US); Davy E. Passucci, Lancaster, NY (US)

(73) Assignee: Paul Kristen, Inc., Tonawanda, NY (US)

( * ) Notice: Subject to any disclaimer, the term of this patent is extended or adjusted under 35 U.S.C. 154(b) by 350 days.

(21) Appl. No.: 12/383,006

(22) Filed: Mar. 18, 2009

Related U.S. Application Data

(60) Provisional application No. 61/069,996, filed on Mar. 18, 2008.

(51) Int. Cl.
*E04G 3/30* (2006.01)

(52) U.S. Cl. ..... 182/150

(58) Field of Classification Search ..... 182/150, 182/222, 223, 151; 52/655.1, 645, 646, 64, 52/65; 403/292–294, 306, 387
See application file for complete search history.

(56) References Cited

U.S. PATENT DOCUMENTS

| | | | | | |
|---|---|---|---|---|---|
| 302,102 | A | * | 7/1884 | Checebro et al. | 182/223 |
| 748,962 | A | | 1/1904 | Lewis | |
| 1,658,670 | A | * | 2/1928 | Corbett | 182/223 |
| 1,810,579 | A | * | 6/1931 | Schmitz | 52/782.22 |
| 1,819,031 | A | | 8/1931 | Kuhlman | |
| 1,896,746 | A | | 2/1933 | Henry | |
| 2,303,428 | A | | 12/1942 | Black | |
| 2,740,873 | A | * | 4/1956 | Cronk | 200/295 |
| 2,744,590 | A | * | 5/1956 | Butts | 52/645 |
| 2,882,099 | A | | 4/1959 | Symons | |
| 2,903,282 | A | | 9/1959 | Wright et al. | |
| 2,987,148 | A | | 6/1961 | Millard | |
| 2,994,402 | A | | 8/1961 | Tyler | |
| 3,144,105 | A | * | 8/1964 | Capek | 403/387 |
| 3,389,929 | A | * | 6/1968 | Williams | 403/73 |
| 3,420,011 | A | | 1/1969 | Takahashi | |
| 3,425,179 | A | * | 2/1969 | Haroldson | 52/283 |
| 3,635,509 | A | | 1/1972 | Birkemeier et al. | |
| 3,703,307 | A | * | 11/1972 | Curtis | 403/173 |
| 3,727,362 | A | * | 4/1973 | Ellison et al. | 52/650.1 |
| 3,888,371 | A | | 6/1975 | Moreau | |
| 4,042,991 | A | * | 8/1977 | Macy et al. | 14/77.1 |
| 4,073,025 | A | * | 2/1978 | Peckham | 14/2.4 |
| 4,234,055 | A | | 11/1980 | Beeche | |
| 4,244,152 | A | | 1/1981 | Harper, Jr. | |

(Continued)

FOREIGN PATENT DOCUMENTS

AU 774316 B2 11/2001

*Primary Examiner* — Alvin Chin Shue
*Assistant Examiner* — Jaime F Cardenas-Garcia
(74) *Attorney, Agent, or Firm* — James C. Simmons

(57) ABSTRACT

A combination of parts for and method of constructing a modular platform. A frame beam connector member is connected to respective end portions of a pair of frame beams while the pair of frame beams are in substantially a side-by-side relation. One of the frame beams is then swung relative to the other to a co-axial position of the frame beams relative to each other. Then another frame beam connector member is connected to the respective end portions of the frame beams while the frame beams are in the co-axial position thereby to maintain the pair of frame beams in the co-axial position. A deck support beam is connected to a frame beam while in substantially a side-by-side relation therewith. The deck support beam is then swung to a position normal to the frame beams. The deck support beam is then connected to another frame beam.

20 Claims, 14 Drawing Sheets

U.S. PATENT DOCUMENTS 4,253,548 A 3/1981 Beeche
4,475,841 A 10/1984 Eberlein
4,566,245 A 1/1986 Ruter
4,574,535 A 3/1986 Pabsch
4,660,680 A 4/1987 Potin
4,685,535 A 8/1987 Bush et al.
4,815,563 A 3/1989 Puccinelli et al.
4,967,875 A 11/1990 Beeche
5,061,001 A 10/1991 Madden et al.
5,203,428 A 4/1993 Beeche
5,214,899 A 6/1993 Beeche et al.
5,274,980 A 1/1994 Zeigler
5,409,082 A * 4/1995 Matthews ..... 182/222
D364,531 S 11/1995 Berner et al.
5,617,931 A 4/1997 Zygmun et al.
5,660,017 A * 8/1997 Houghton ..... 52/655.1
5,704,169 A 1/1998 Richter
5,730,248 A 3/1998 Apostolopoulos
5,771,655 A 6/1998 Strickland et al.
5,771,665 A 6/1998 Nelson et al.
5,785,148 A 7/1998 Wildner
5,921,346 A 7/1999 Apostolopoulos
6,003,634 A 12/1999 Apostolopoulos
6,135,240 A 10/2000 Apostolopoulos
6,138,793 A 10/2000 Apostolopoulos
6,205,739 B1 3/2001 Newlin
6,217,344 B1 4/2001 Saito et al.
6,223,482 B1 5/2001 Zohar
6,227,331 B1 5/2001 Apostolopoulos
6,264,002 B1 7/2001 Apostolopoulos
6,302,237 B1 10/2001 Apostolopoulos
6,357,549 B1 3/2002 Brennan et al.
6,386,319 B2 5/2002 Apostolopoulos
6,523,644 B2 2/2003 Apostolopoulos
6,675,546 B2 * 1/2004 Coles ..... 52/655.1
6,799,658 B2 10/2004 Cogar et al.
6,918,152 B2 7/2005 Fuessinger et al.
7,325,796 B2 * 2/2008 Moreland ..... 267/293
7,478,449 B2 * 1/2009 Williams ..... 14/69.5
7,614,511 B2 * 11/2009 Konstant ..... 211/189
7,748,681 B2 * 7/2010 Dent ..... 248/548
2002/0053179 A1 * 5/2002 Wycech ..... 52/721.4
2003/0010740 A1 * 1/2003 Konstant ..... 211/189
2003/0155319 A1 * 8/2003 Wishart et al. ..... 211/189
2004/0128942 A1 7/2004 Beeche
2005/0077107 A1 * 4/2005 Libert et al. ..... 182/119
2005/0217936 A1 10/2005 Jolicoeur et al.
2007/0196164 A1 * 8/2007 Dent ..... 403/2

* cited by examiner

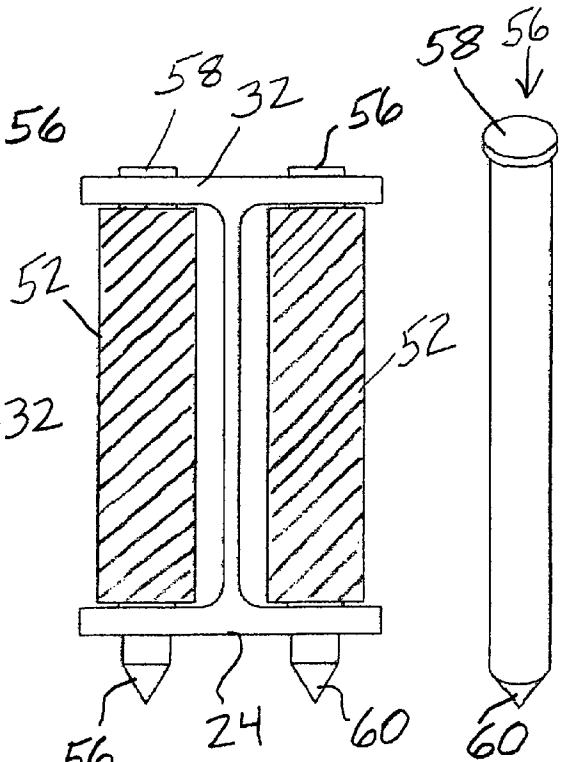
FIG. 4
FIG. 3
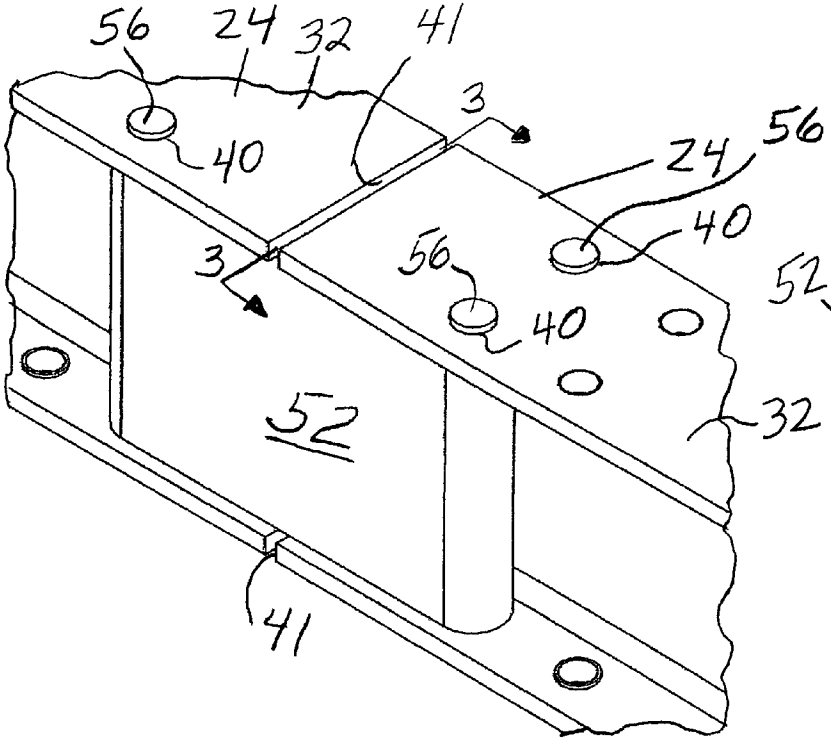
FIG. 2

MODULAR PLATFORM/ SCAFFOLDING

Applicants claim priority of U.S. provisional application 61/069,996, filed Mar. 18, 2008, which is hereby incorporated herein by reference.

The present invention relates generally to platforms such as may be erected below a bridge deck for cleaning, painting, or other maintenance work thereon. As used herein and in the claims, the term "platform" is meant to include other forms of scaffolding.

Art which may be of interest to the present invention includes U.S. Pat. Nos. 748,962; 1,819,031; 1,896,746; 2,303,428; 2,882,099; 2,903,282; 2,987,148; 2,994,402; 3,420,011; 3,425,179; 3,635,509; 3,888,371; 4,234,055; 4,244,152; 4,253,548; 4,475,841; 4,566,245; 4,574,535; 4,660,680; 4,685,535; 4,815,563; 4,967,875; 5,061,001; 5,203,428; 5,214,899; 5,274,980; 5,617,931 (discloses modular scaffolding utilizing aluminum side trusses); 5,704,169; 5,771,655; 5,771,665; 5,785,148; 6,205,739; 6,217,344; 6,223,482; 6,357,549; 6,799,658; 6,918,152; D364,531, and U.S. patent application publication 2004/0128942, all of which are incorporated herein by reference.

Applicant, Lambros Apostolopoulos, has for many years provided, for use by workmen under bridge decks, platforms which comprises a plurality of cables strung between bridge piers or the like and paneling laid cross-wise of the cables and attached thereto. The cables are supported along their lengths by vertical cables attached to the paneling attachment structure and to overlying structural portions of the bridge. These platforms, which have served the industry well over many years, are described more specifically in Applicant's (Lambros Apostolopoulos) U.S. Pat. Nos. 5,730,248; 5,921,346; 6,003,634; 6,135,240; 6,138,793; 6,227,331; 6,264,002; 6,302,237; 6,386,319; and 6,523,644, all of which are incorporated herein by reference.

A modular trussed platform is described in Australian patent 774316 (based on Australian application AU 200138987), the disclosure of which is incorporated herein by reference, which utilizes cluster posts between which truss units are attached, which allows the trusses to span in both longitudinal and transverse directions. Each cluster post has 4 circumferentially spaced slots for receiving end edges of the truss units. The truss units are attached to the cluster posts by lock pins. It is stated on page 7 thereof that each section can be cantilevered prior to hanging. FIG. 7 thereof shows a structure suspended by suspension wire attached to cluster posts or trusses. FIG. 9 thereof shows cluster posts extending below the trusses to support a deck from below. Such a system requires cranes or the like to move the trusses into position for attachment, which is cumbersome and expensive.

U.S. patent application publication 2005/0217936, published Oct. 6, 2005 (and PCT application publication WO2005096725, published Oct. 20, 2005, is believed to correspond and be cumulative thereto), and the disclosures of which are incorporated herein by reference, discloses a work platform wherein a plurality of joists, such as trusses, are pivotally attached to a plurality of hubs. The hubs have cylindrical middle sections and upper and lower planar elements with circumferentially spaced holes therein for connecting the joists. Pins are received in the holes and in holes in the joists for connecting the joists to the hubs so that the joists articulate. Hubs are suspended from a bridge or other structure by cables or chains. Erection of the structure requires the workers to hold the heavy joists adjacent the edges of previously installed platform segments, apply the pins, then push the articulated heavy joists into position. Such a process is very dangerous due to the chances of slipping and falling. In addition, there is difficulty with such a truss structure in building around obstacles and in tight areas.

It is accordingly an object of the present invention to provide a modular platform/scaffolding structure which can be erected and dismantled easily and safely and quickly, without the use of cranes or other heavy equipment.

It is another object of the present invention to provide such a modular structure which has the flexibility in erecting to allow building easily around obstacles and in tight areas.

It is a further object of the present invention to provide such a modular structure wherein each of the individual components can be easily manipulated and attached and unattached by a single person.

It is a still further object of the present invention to provide such a modular structure which has a generally flat walking surface.

It is yet another object of the present invention to provide such a modular structure which is rugged and reliable and strong and has minimal height (vertical dimension).

In order to provide such a modular platform/scaffolding structure, in accordance with the present invention, frame beams have apertures spaced in their flanges (along each side) over their lengths to receive pins for swingably receiving the ends of deck support beams thereby to allow flexibility in locating the deck support beams along the lengths of the frame beams. Further in accordance with the present invention, the ends of two frame beams are connected by pins received in end ones of the frame beam apertures and in a first connector, in a manner allowing one frame beam to be substantially side-by-side with the other frame beam while being connected and then allowing it to be swung into a position wherein the frame beams are co-axial and then rigidly secured in that position by pins received in the other end apertures (on respectively opposite sides of the respective frame beam flanges) and in a second connector.

The above and other objects, features, and advantages of the present invention will be apparent from the following detailed description of the preferred embodiment(s) thereof when read in conjunction with the appended drawings wherein the same reference numerals denote the same or similar parts throughout the several views.

BRIEF DESCRIPTION OF THE DRAWINGS

FIG. 2 is a partial perspective view illustrating the attachment of the ends of two frame beams of the platform.

FIG. 3 is a section view taken along lines 3-3 of FIG. 2.

FIG. 4 is a perspective view of a pin for the attachment of the frame beams.

DETAILED DESCRIPTION OF THE PREFERRED EMBODIMENT(S)

Figure 1:
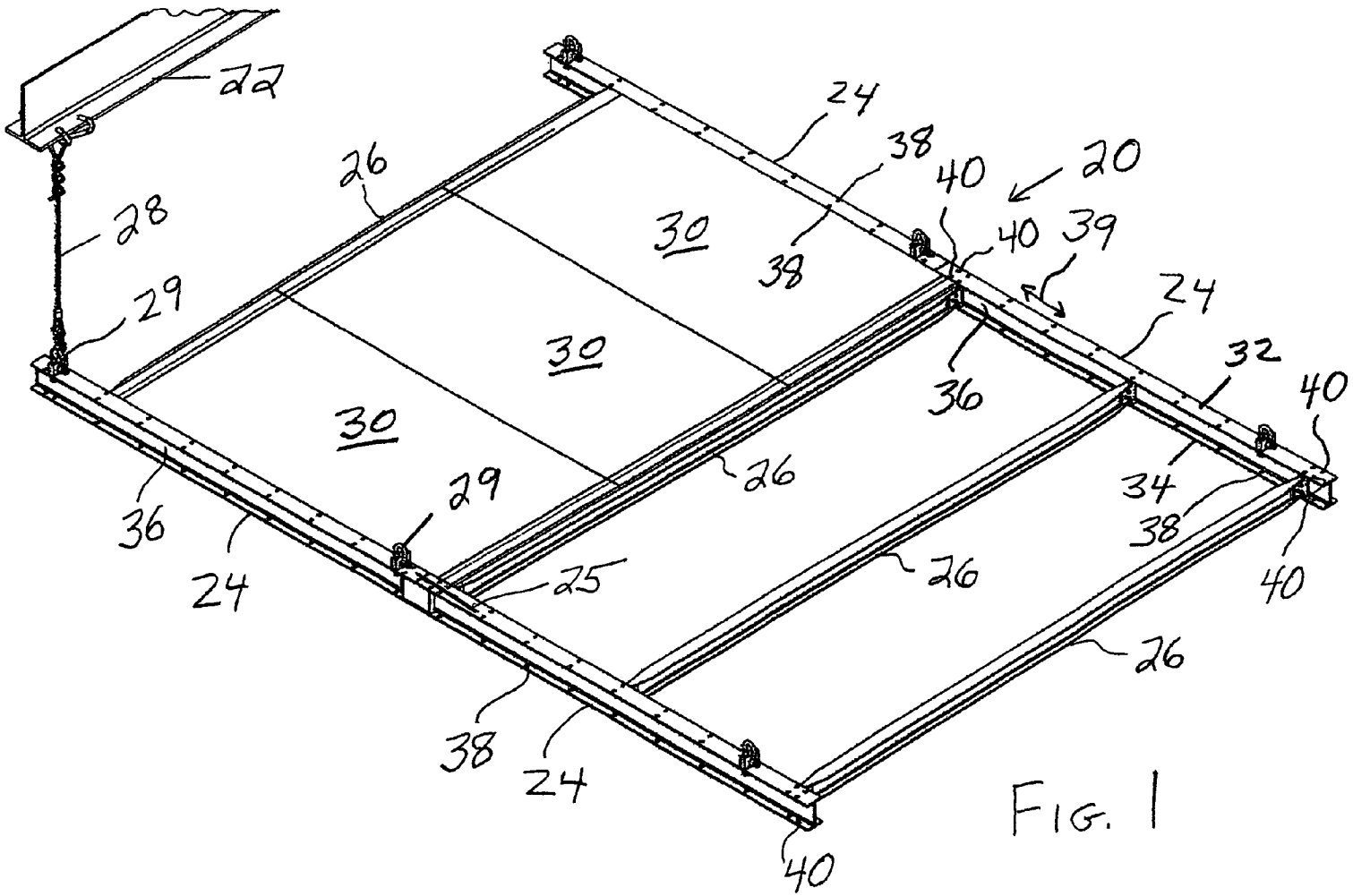
FIG. 1 is a perspective view of a portion of a platform which embodies, shown schematically attached to a bridge.
Figure 12:
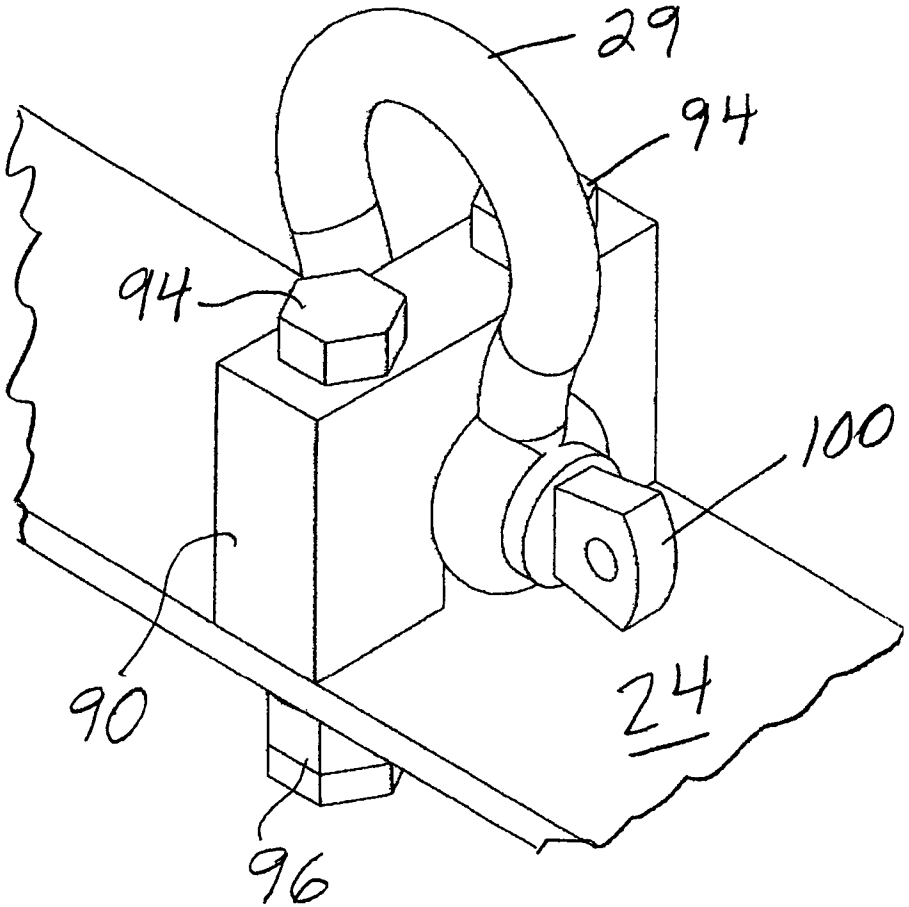
FIG. 12 is a perspective view of a shackle for attachment of the platform to the bridge and illustrating its attachment to a frame beam.

Referring to FIG. 1, there is shown generally at 20 a portion of a modular platform which may be used, for example, for work such as cleaning or painting to be conducted on a bridge a portion of which is illustrated at 22. The platform 20 includes a group of pluralities of interconnected frame beams 24 extending cross-wise of the bridge 22 and deck support beams 26 extending length-wise of the bridge 22 between frame beams 24, it being understood that, alternatively, the frame beams may extend length-wise of the bridge 22 and the deck support beams may extend width-wise of the bridge 22. Vertical cables or chains 28 (only one shown) or the like connect the frame beams 24 to the overhanging bridge structure 22 for support of the platform 20. The cables 28 are connected to shackles 29 which are in turn attached to the frame beams 24, as shown in FIG. 12. As long as sufficient support is provided, it is of course not necessary that every single frame beam 24 be connected to the bridge structure 22 by a cable 28, and, as seen in FIG. 1, a single frame beam 24 may be supported by two or more cables 28. Instead of being supported by hanging from cables, it should be understood that platform 20 may be supported from below, for example, by columns on which some or all of the frame beams 24 are supported, or may otherwise be suitably supported. The platform 20 may of course be used for other purposes such as for scaffolding. Paneling, illustrated at 30, such as, for example, plywood flooring is laid across the deck support beams 26 and secured thereto as is discussed in greater detail hereinafter or in other ways commonly known to those of ordinary skill in the art to which the present invention pertains, to complete the platform 20. FIG. 1 shows two groups of frame beams 24 each group having two frame beams 24 shown connected end-to-end co-axially, as illustrated by their having a common longitudinal axis, illustrated at 25. It should be understood that the platform 20 may have any number of groups of frame beams 24 and any number of frame beams 24 in each group, for example, the number of groups may be determined by the bridge length or portion thereof to be spanned, and the number of frame beams 24 in each group determined by the bridge width or portion thereof to be spanned. For purposes of clarity of illustration, three deck panels 30 are shown covering a portion of the platform portion 20 of FIG. 1, it being understood that three other deck panels 30 would cover the other portion thereof. Each of the deck panels 30 is shown to be laid to extend between and be connected to two deck support beams 26, as hereinafter discussed in greater detail, and to overlie, centrally thereof, another deck support beam 26, it being understood that various other deck panel layouts are envisioned, for example, the number of deck panels may vary and they may overlie none or a greater number of deck support beams 26.

Each beam 24 and 26 is composed of aluminum or other suitable light-weight strong material and is suitably short so that its weight is such (less than about 50 pounds) that it can be easily and quickly manipulated and connected and unconnected by a single person. For example, each of the frame beams 24 may be about 8 to 10 feet long, and each of the deck support beams 26 may be about 12 feet long. The deck support beams 26 have a smaller depth for reasons discussed hereinafter. The frame and deck support beams 24 and 26 respectively may be, for example, I-beams having sizes I-6 and I-4 respectively, i.e., depths, along their central webs, of 6 and 4 inches respectively, with the result that the deck support beams 26 can be inserted between the flanges of the frame beams 24, as discussed hereinafter. Each of the plywood panels 30 may, for example, be composed of treated fire resistant plywood and be 4 feet by 8 feet and have a thickness of about ¾ inch, so that, weighing, for example, less than about 50 pounds, it may be easily and quickly manipulated and connected and disconnected by a single person. The short aluminum beams 24 and 26 are, for example, lighter than the plywood panels 30, so that each of the platform components has a weight (less than about 50 pounds) such that it can be easily and quickly manipulated and connected and disconnected by a single person, thus reducing the amount of required manpower for erecting and disassembling the platform 20.

Each of the frame beams 24 comprises upper and lower flanges 32 and 34 respectively connected by a central vertical web 36. A quantity of spaced apertures, illustrated at 38, which may, for example, have a diameter of about 11/16 inch, are provided along and adjacent each edge of the upper and lower flanges 32 and 34 respectively. In order to maximize flexibility for positioning of the deck support beams 26 and shackles 29 along the lengths of the frame beams 24 respectively, the apertures 38 are preferably spaced closely together, preferably in equal increments. For example, the apertures 38 may be spaced about 12 inches (on centers) apart, as illustrated at 39, with end apertures, illustrated at 40, (on centers) being spaced, for example, about 3½ inches from the frame beam edge and about 2⅜ inches from the adjacent set of apertures 38. As seen in FIG. 2, when attached, there is a gap, illustrated at 41, between the edges of the frame beams 24, this gap 41 being, for example, about ¼ inch.

Figure 5:
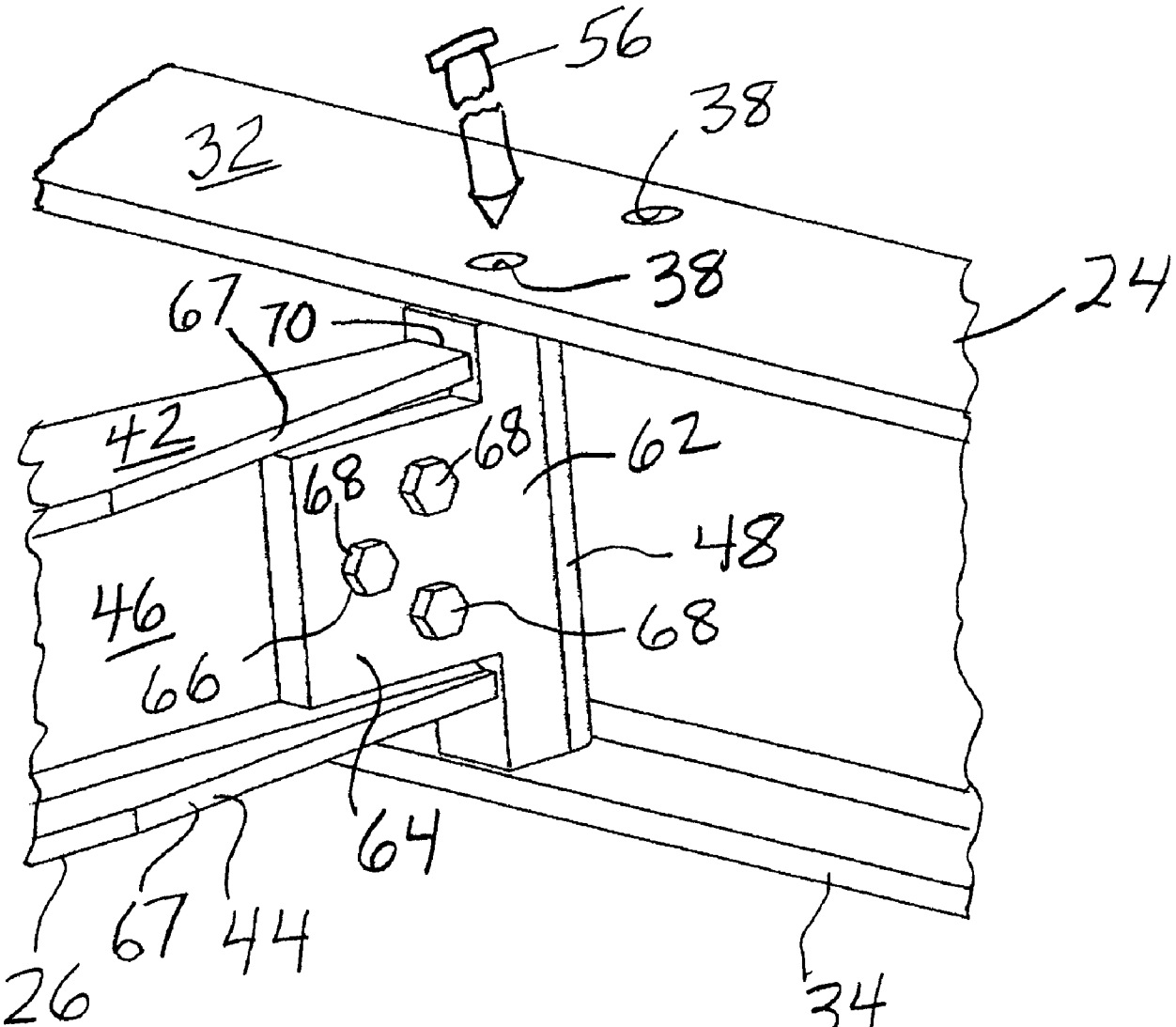
FIG. 5 is a partial perspective view illustrating the attachment of a deck support beam to one of the frame beams.
Figure 7:
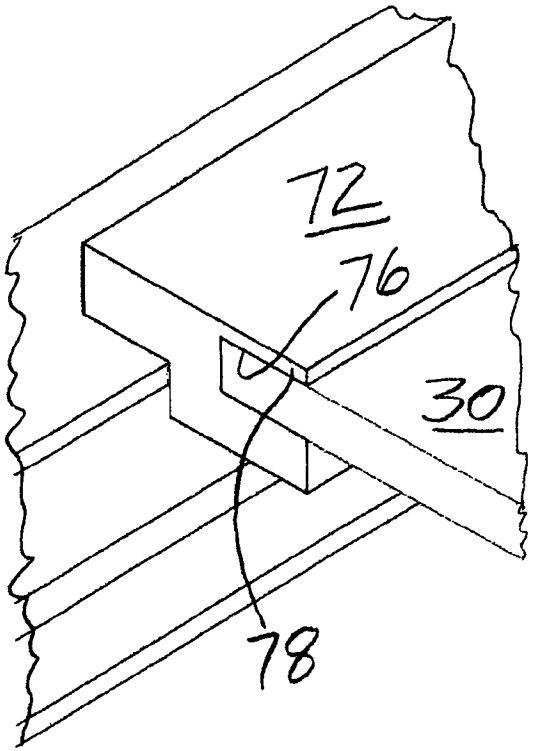
FIG. 7 is an enlarged detail view of the attachment of FIG. 6.
Figure 6:
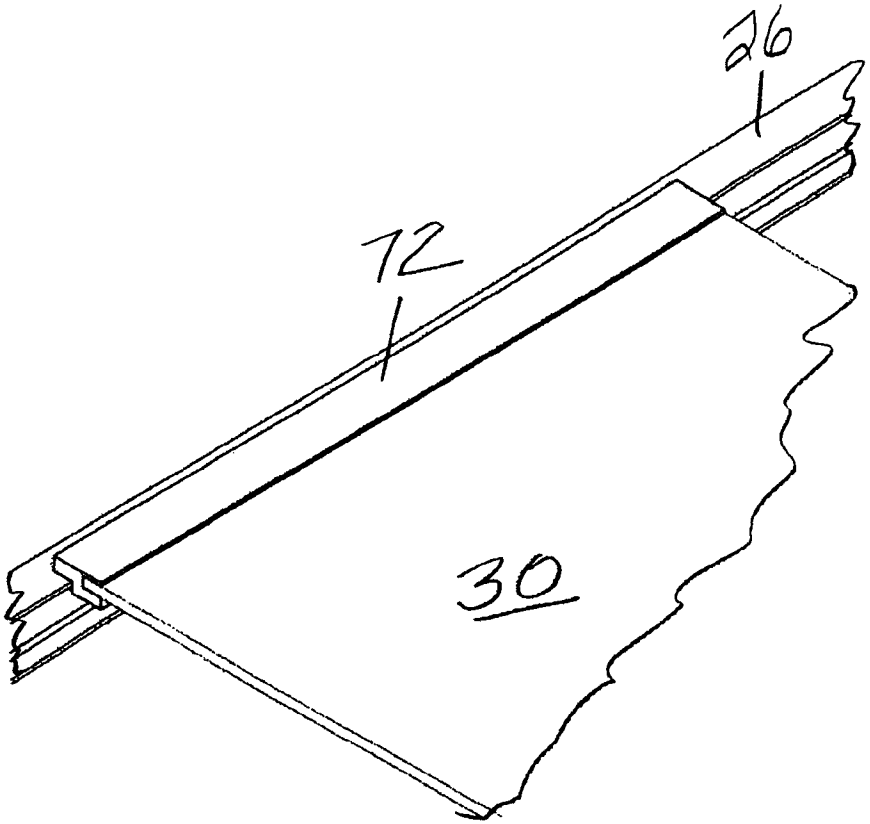
FIG. 6 is a partial perspective view illustrating the attachment of one edge of a deck member to a deck support beam.
Figure 14:
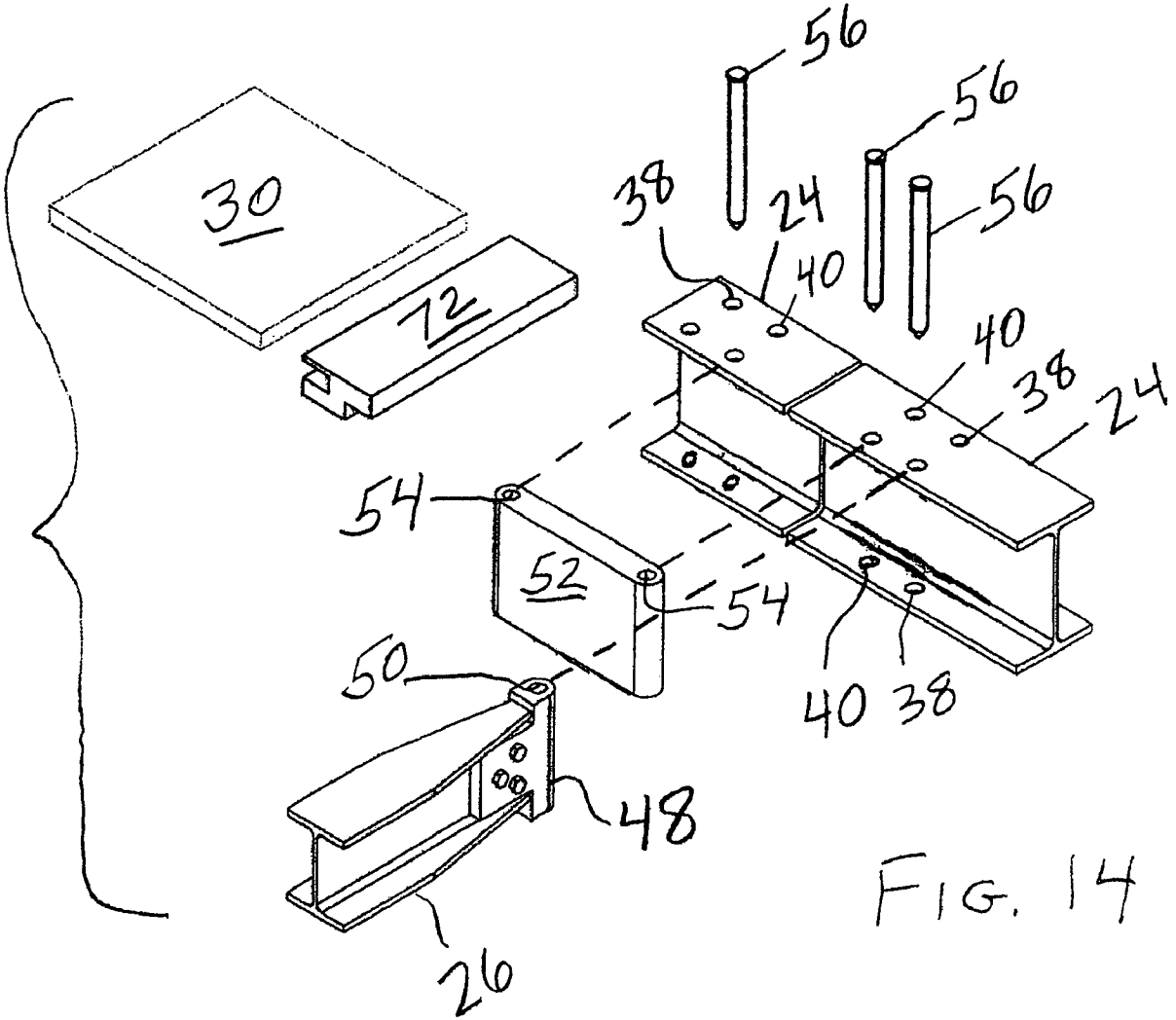
FIG. 14 is an exploded view of various components of the platform.

As seen in FIG. 5, the deck support beams 26, which also have upper and lower flanges 42 and 44 respectively connected by a central vertical web 46, are suitably attached to the frame beams 24 such as, for example, by aluminum blocks 48 each having a central aperture 50 (FIG. 14) extending vertically entirely therethrough, as described in greater detail hereinafter.

Each group of frame beams 24 comprises a plurality of frame beams 24 connected end-to-end co-axially to extend the width of the bridge 22 or otherwise desired distance, with additional groups of frame beams 24 laid parallel thereto along the bridge length or otherwise desired distance (with the deck support beams 26 inserted between and attached at their ends to respective frame beams 24 to extend normal or perpendicular thereto).

Figure 26:
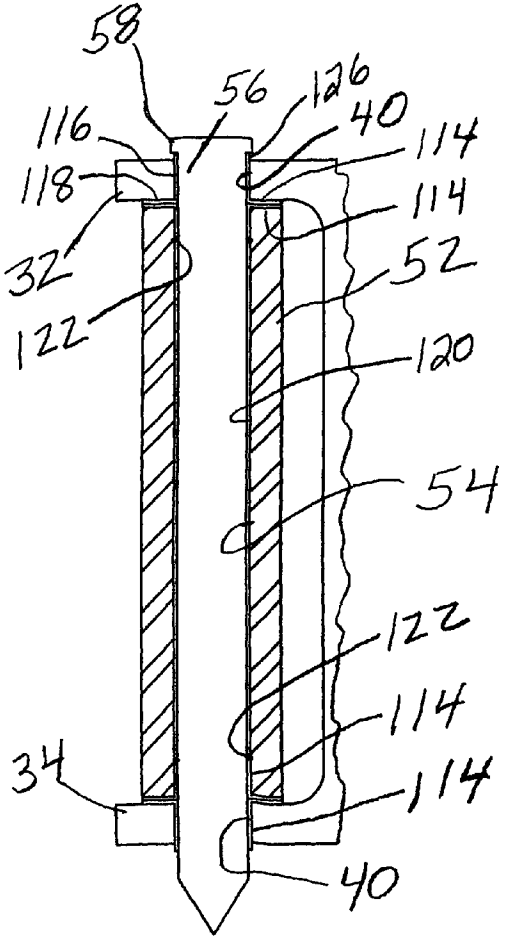
FIG. 26 is a sectional view of a frame beam connector showing the pin received in an aperture thereof and in the corresponding frame beam apertures.
Figure 27:
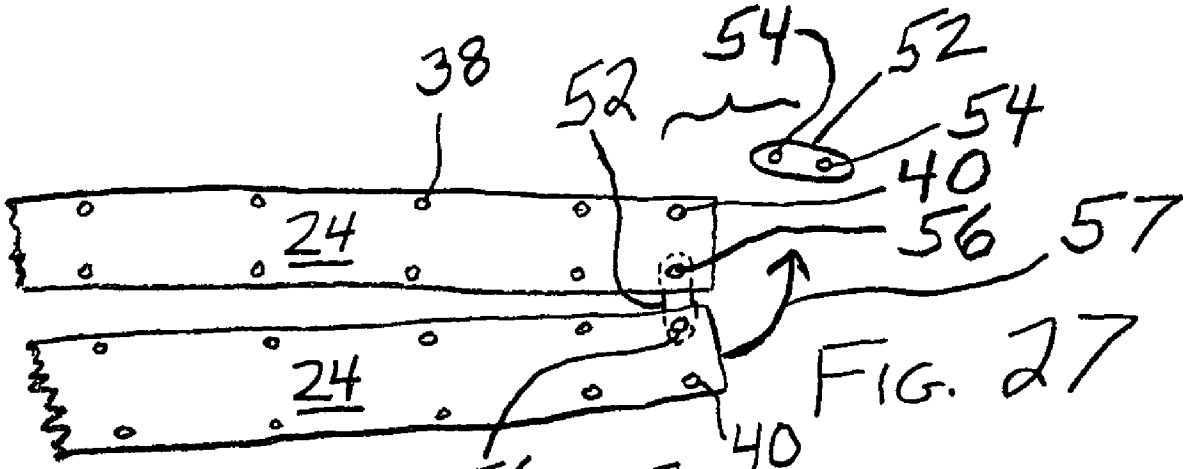
FIGS. 27 and 28 are schematic views of a portion of the platform in successive stages of assembly.
Figure 28:
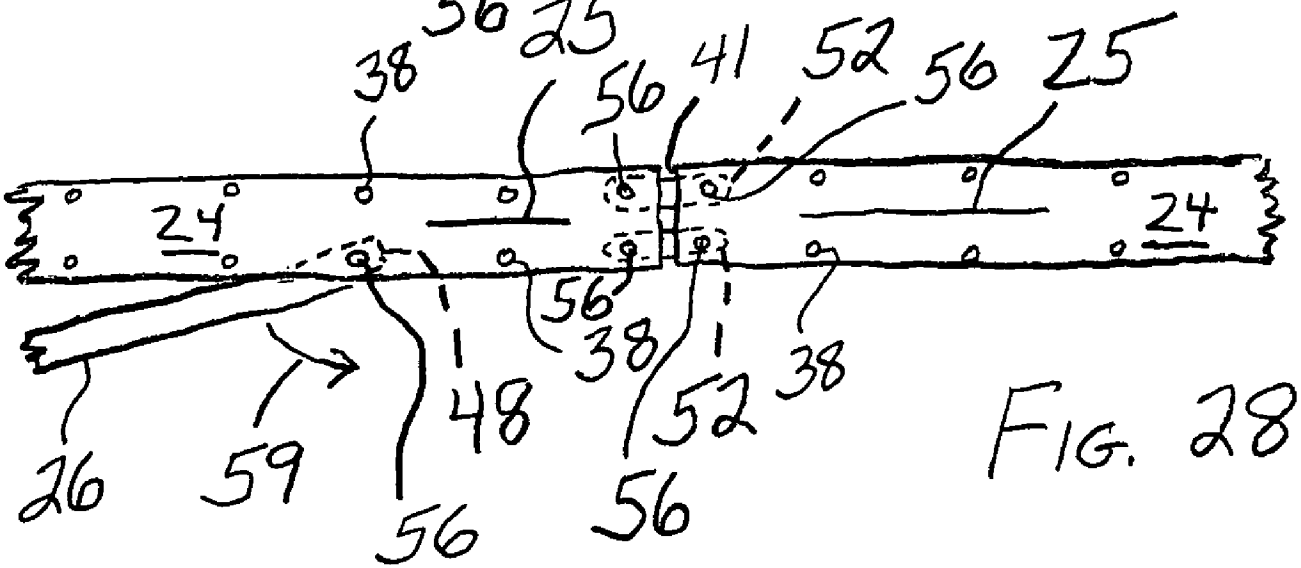

As seen in FIGS. 2 to 4 and 23 to 28, a pair of end-to-end co-axial frame beams 24 are connected by a pair of connectors 52, which may, for example, be blocks composed of extruded aluminum or other suitable material and having a pair of spaced apertures 54, whose spacing is such as to allow them to be aligned with the apertures 40 adjacent the ends of the respective frame beams 24, leaving the gap 41. When the pair of frame beams 24 is in the rigidly attached end-to-end co-axial relationship to maintain the co-axial relation, as seen in FIG. 28, the pair of connectors 52 span the ends of the flanges 32 and 34 respectively on the respective flange sides. The connection to each frame beam 24 is by means of a pin 56 which is received in the respective upper and lower flange apertures 40 and in the respective connector aperture 54, which may, for example, have a diameter of about ⅝ inch, as discussed in greater detail hereinafter. The pin 56 may be composed, for example, of suitably hardened steel or stainless steel and have an upper cap portion 58 to rest on top of the upper flange 32 and a lower tapered or pointed end 60 for ease of insertion.

In order to install a frame beam 24 to a previously installed frame beam 24, the frame beam 24 to be installed may be held in a substantially side-by-side relation relative to the previously installed frame beam 24, as illustrated in FIG. 27, and one of the connectors 52 attached by insertion of the pins 56 respectively. The frame beam 24 to be installed is then swung (about the off-center attachment of the pins 56) around, as illustrated at 57 in FIG. 27, to position it in the desired end-to-end co-axial relation with the previously installed frame beam 24, as illustrated in FIG. 28, and the second connector 52 attached by insertion of the pins 56 respectively.

The beams 24 and 26 may be provided in different lengths to allow flexibility in construction, but the beams 24 are otherwise desirably identical and the beams 26 are otherwise desirably identical and the connectors 48 are desirably identical to allow minimization of the types of parts needed for erecting the modular platform. Likewise, the first and second connectors 52 and the pins 56 are desirably identical.

As seen in FIG. 5, a deck support beam 26 is attached to a frame beam 24 by means of block 48. The block 48 may advantageously be formed by machining an extruded block 52 to form therefrom a portion 62 containing one of the apertures 54 and two spaced flanges 64 (only one seen in FIG. 5) extending laterally therefrom. Each of the flanges 64 is sized height-wise to fit between the deck support beam flanges 42 and 44 and is shown to have three aligned triangularly-spaced apertures, illustrated at 66, which also align with apertures (not shown) in the respective end of the deck support beam web 46 wherein the web 46 is sandwiched between the flanges 64, and bolts 68 are inserted in the apertures 66 and the deck support beam web apertures respectively and nuts (not shown) suitably applied to rigidly secure the machined block 62 to the respective end of the deck support beam 26.

With the block 62 thusly rigidly attached, the block portion 62 is received between the flanges 32 and 34 with its aperture 54 aligned with the apertures 38 and a pin 56 inserted within the respective flange apertures 38 and the block aperture 54, similarly as the pins 56 attach the extruded blocks 52 to the ends of two frame beams 24 to connect them together, as discussed in greater detail herein. During such attachment, the deck support beam 26 may desirably be held next to or alongside the frame beam 24, i.e., in a substantially side-by-side relation, as illustrated in FIG. 28, then swung into position, as illustrated at 59 in FIG. 28, after the pin 56 has been inserted, to the position shown in FIG. 1 wherein deck support beam 26 is normal or perpendicular to the respective frame beam 24. The ends of the flanges 42 and 44 are suitably chamfered, as illustrated at 67, for example, over a distance of about 6 inches, to narrow ends 70 to prevent interference with the corresponding frame beam 24. The close spacing of the frame beam apertures 38 allows flexibility for positioning of the deck support beams 26 generally anywhere there along, including flexibility for erecting around obstacles and in tight areas.

The attachment of a second frame beam 24 to the other ends of deck support beams 26 previously attached to a first frame beam 24 may be with the deck support beams 26 rotated or swung into a position adjacent (substantially side-by-side with) the first frame beam 24, then the assembly rotated out into position for attachment of the second frame beam 24 in end-to-end co-axial relation with a previously attached frame beam 24. Thus, the frame beams 24 and the deck support beams 26 may desirably be attached in either order, allowing flexibility for erection.

Referring to FIGS. 6 to 11, opposite ends of each flooring panel 30 is suitably attached to extruded aluminum (or other suitable material) elongate members 72 which are in turn attached to respective deck support beams 26, as described hereinafter. Thus, each of the members 72 has an upper slot, illustrated at 76, extending into one side thereof and defined by a thin upper lip 78 and in which is frictionally or snugly received the respective edge portion of the respective flooring panel 30. A notch, illustrated at 74, is formed in the other side lower corner of the member 72 in which is receivable the respective one side of the upper flange 42.

Figure 10:
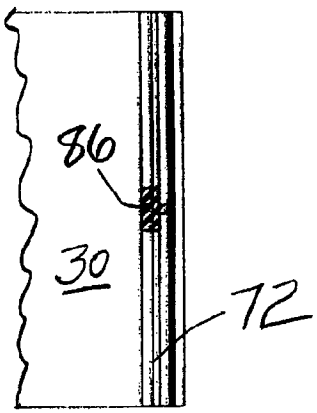
FIG. 10 is a partial plan view of the attachment of the opposite edge of the deck member of FIGS. 6 to 9 to another deck support beam.
Figure 8:
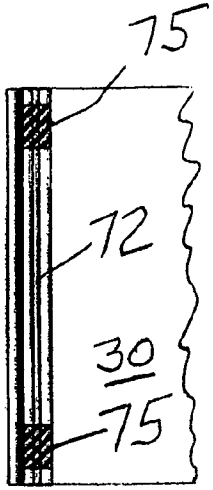
FIG. 8 is a partial plan view of the attachment of FIGS. 6 and 7.
Figure 11:
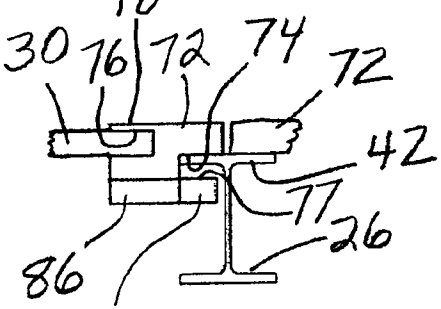
FIG. 11 is a view similar to that of FIG. 9 showing the attachment of FIG. 10.
Figure 9:
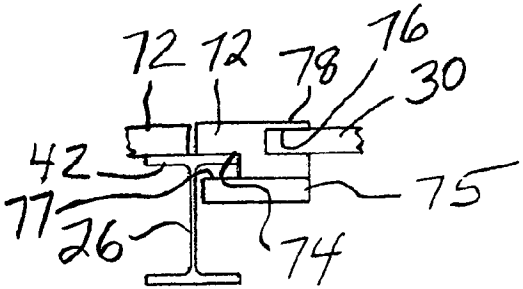
FIG. 9 is an edge view showing the attachment of FIG. 8.

FIGS. 8 and 9 illustrate the member 72 as applied to one panel edge and the means for its attachment to the respective deck support beam 26, and FIGS. 10 and 11 illustrate the member 72 as applied to the opposite panel edge and the means for its attachment to the respective deck support beam 26.

Referring first to FIGS. 8 and 9, a pair of spaced plates 75 (near the ends of the member 72) are suitably attached such as by screws or bolts or welding (not shown) to the lower surface of the member 72, the plates 75 extending inwardly to overlap the notch 74 and form therewith a slot, illustrated at 77, in which the respective facing side or half of the upper flange 42 is received for the purpose of securing the one side of the panel 30.

Referring now to FIGS. 10 and 11, a suitably spring-loaded locking mechanism 86 having a protrudable bolt or tongue 88 is suitably attached such as by screws or bolts (not shown) to the lower surface of the member 72, centrally thereof, the bolt 88 when protruding extending inwardly to overlap the notch 74 and form therewith a slot, illustrated at 77, in which the respective facing side or half of the upper flange 42 is received for the purpose of securing the other side of the panel 30. The locking mechanism 86 and bolt 88 are similar to mechanisms and bolts found on many doors to cause a door to automatically lock when pulled closed. Thus, the bolt 88 is adapted to be pushed into the locking mechanism 86, which is spring-loaded to bias the bolt 88 to the outward position shown in FIG. 11. The bolt 88 lower surface is suitably shaped to cause the bolt 88 to be pushed inwardly of the locking mechanism 86 when force is applied to it from above against the upper flange 42. The spring-loaded mechanism 86 forces the bolt 88 outwardly into the position shown in FIG. 11 once the upper flange 42 is cleared. The principles of construction of such a locking mechanism 86 and bolt 88 are well known to those of ordinary skill in the art to which the present invention pertains.

In order to attach a deck panel 30 between two deck support beam 26, the connectors 72 are applied to the opposite panel edges and may be suitably glued thereto, the two connectors 72 for one edge having the members 75 attached and the connector 72 for the other edge having the locking mechanism 86 and bolt 88 attached. The panel 30 is positioned so that the flange 42 is received in the slot 77 formed by the member 75. Then, with the bolt 88 lying above the flange 42 for the other deck support beam 26, downward force is applied, causing the bolt 88 to retract into the locking mechanism 86 so that the flange 42 can be received in the slot 77 formed by the bolt 88. Then, the spring force of the locking mechanism 86 forces the bolt 88 back outwardly to again form the slot 77 with the flange 42 securely received therein. Once in place, the panels 30 make the platform portion rigid.

As seen best in FIGS. 9 and 11, the lower surface of the slot 76 is even with or slightly higher than the surface formed by the notch 74 which rests on top of the deck support beam flange 42 which allows the panels 30 to be positioned heightwise to clear other deck support beams 26, as desired. Thus, as seen in FIG. 1, a deck support beams 26 may be positioned centrally under the three panels 30 for added support thereof as well as making erection easier. As also seen in FIGS. 9 and 11, the lip 78 can be formed to be very thin, such as, for example, ⅛ inch, so that a substantially even or almost flush walking surface may desirably be achieved.

Figure 13:
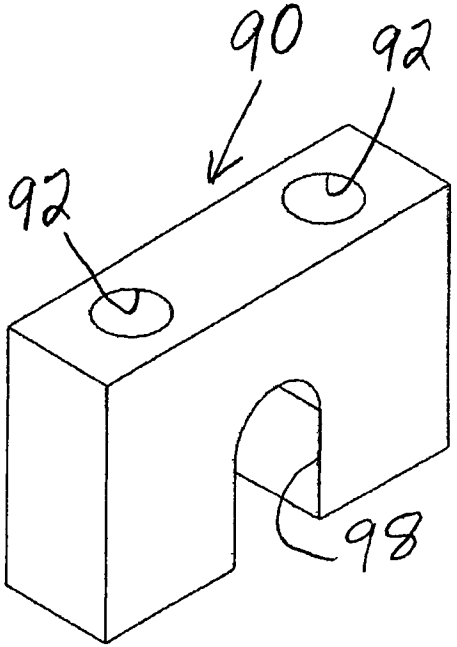
FIG. 13 is a perspective view of the mount for the shackle.

Referring to FIGS. 12 and 13, an extruded block 90 of aluminum or other suitable material is provided to attach each shackle 29 (for example, a ¾ inch shackle) to a frame beam 24. The block 90 is formed to have two apertures, illustrated at 92, extending vertically therethrough and spaced to be alignable with a pair of inner and outer apertures 38 on the frame beams 24. The block 90 is attached by suitable means such as, for example, a pair of bolts 94 (for example, ⅝ inch bolts) received in the apertures 92 and 38 respectively and nuts 96 applied to the bolts 94 to rigidly secure the block 90. A slot, illustrated at 98, is suitably formed in the lower surface of the block 90. When attached to the respective frame beam 24, it forms therewith an opening in which is receivable a fastener member 100 for attaching the shackle 29 to the frame beam 24.

Figure 15:
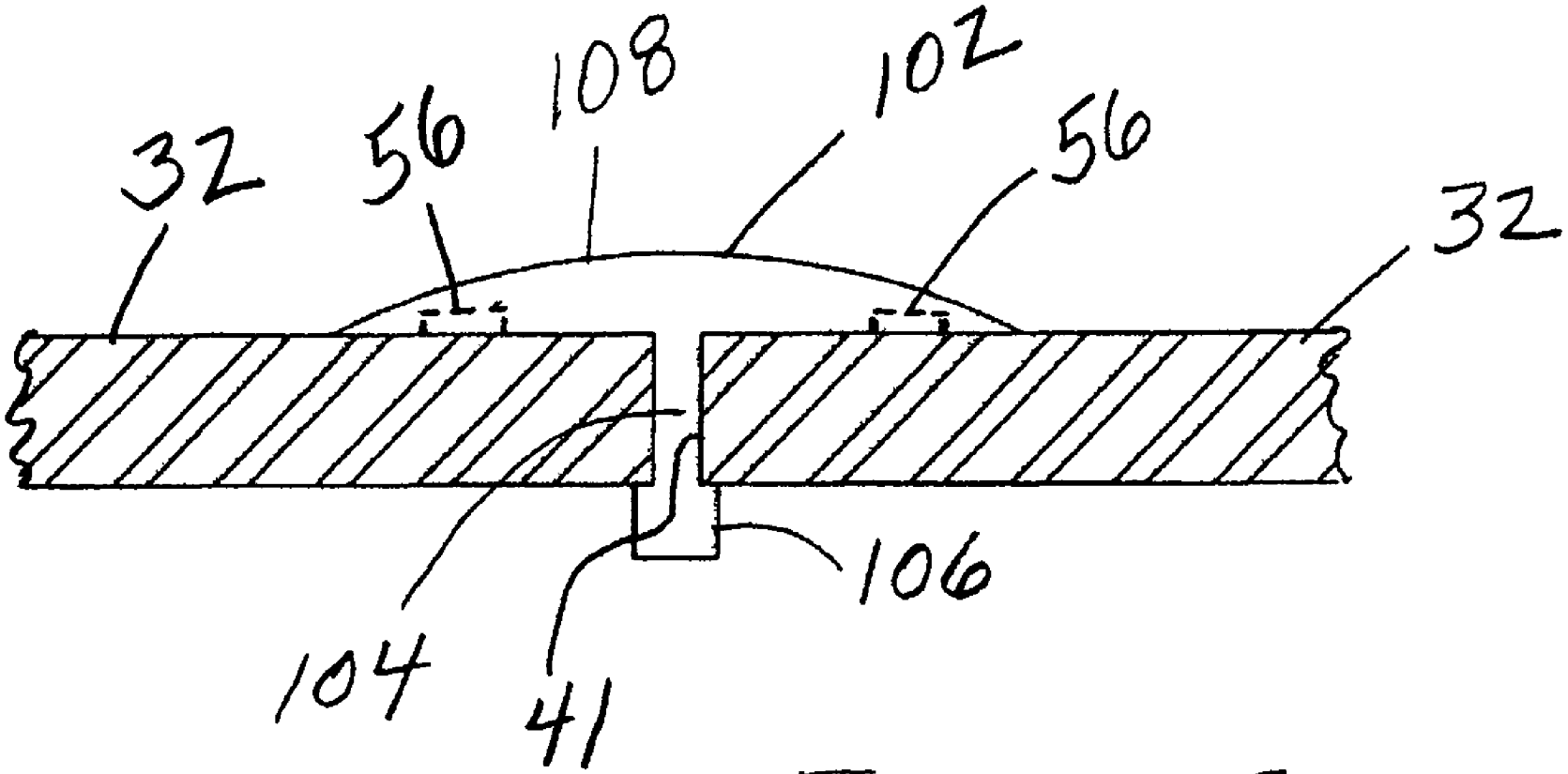
FIG. 15 is an enlarged detail view, partly in section, illustrating a seal inserted between edges of attached frame beams.

Referring to FIG. 15, an elastomeric seal member or self-sealing rubber seal 102 has a central portion 104 which is received within the gap 41 between adjacent flanges 32 of frame beams 24 respectively and terminates in an enlarged lower portion 106 which is receivable below and engages the lower surfaces of the flanges 32 so that it is securely held within the gap 41. The seal 102 extends over the entire length of the gap 41. The upper end of the central portion 104 terminates in a cap portion 108 which is sized to cover the caps 58 of the pins 56 to protect and secure them against dislodgement. The elastomeric material is such as to allow the portion 106 to be compressible to be passed through the gap 41 then expand to secure the seal 102 against dislodgement. During disassembly, the portion 106 can then be compressed again by application of suitable pulling force for passage through the gap 41 and removal of the seal 102. Similar seals may be provided in other gaps in the platform such as, for example, in gaps between panels 30.

Figure 16:
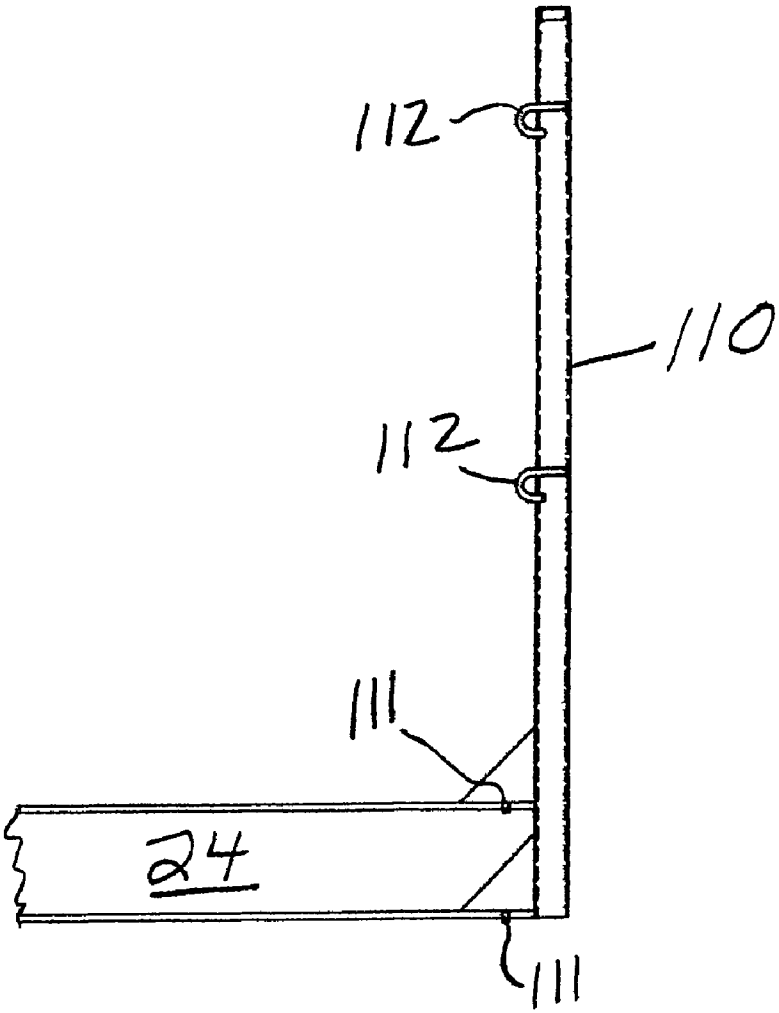
FIG. 16 is a generally schematic view of a hand rail attached to the platform.
Figure 17:
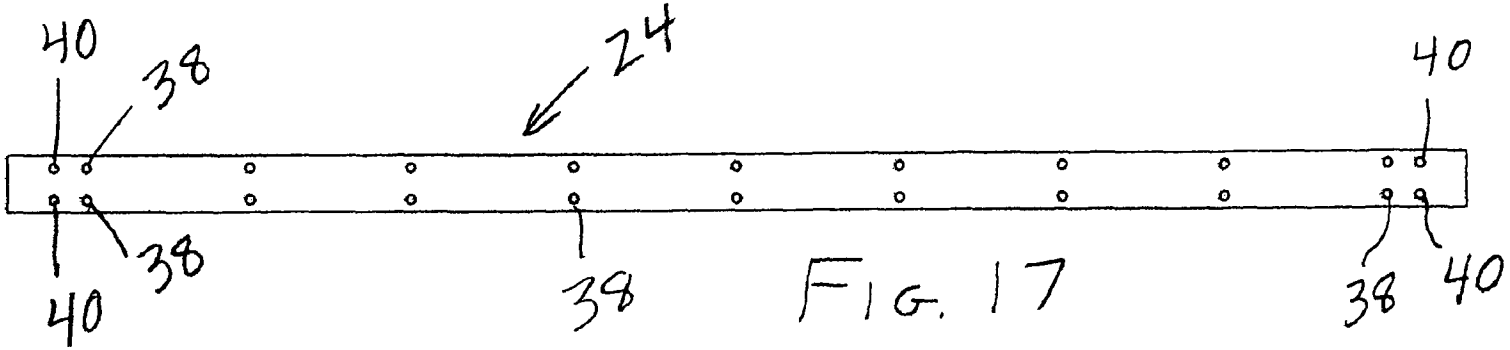
FIG. 17 is a plan view of a frame beam.
Figure 18:
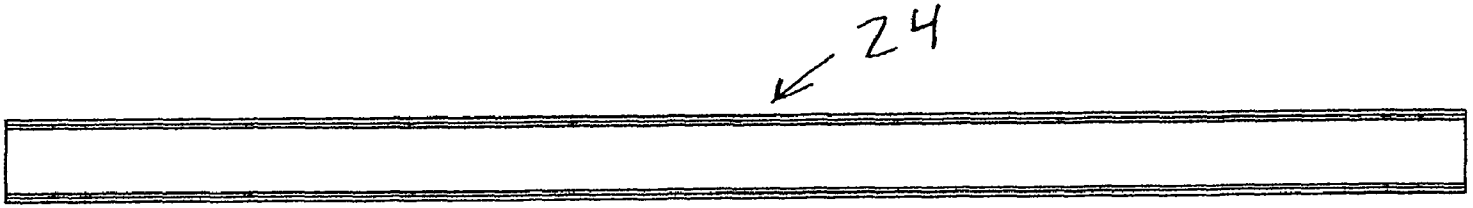
FIG. 18 is a side view of the frame beam.
Figure 19:
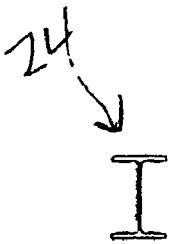
FIG. 19 is an end view of the frame beam.
Figure 20:
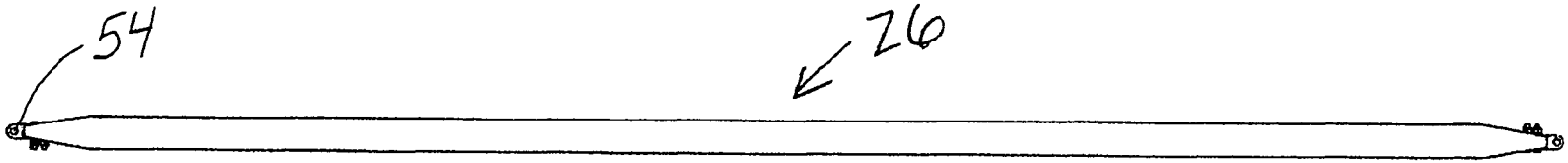
FIG. 20 is a plan view of a deck support beam with attachment members attached at the ends thereof.
Figure 21:
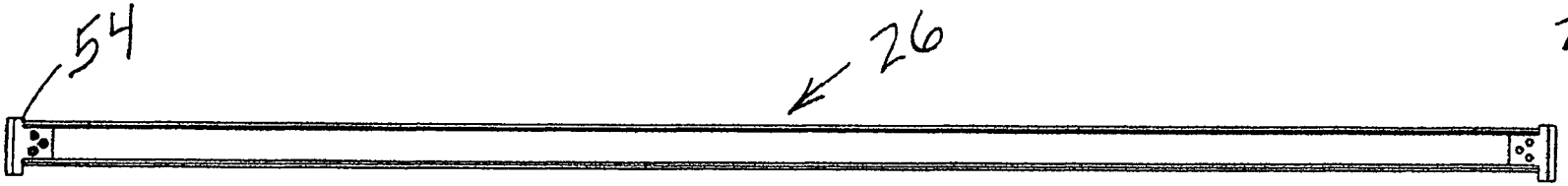
FIG. 21 is a side view of the deck support beam and attachment members.
Figure 22:
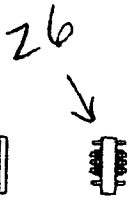
FIG. 22 is an end view of the deck support beam and attachment members.
Figure 25:
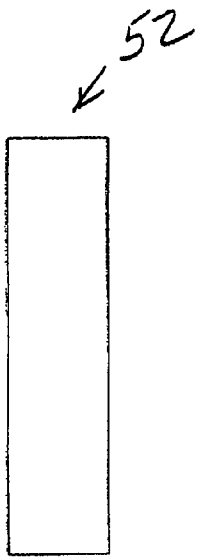
FIG. 25 is an end view of the frame beam connector.
Figure 24:
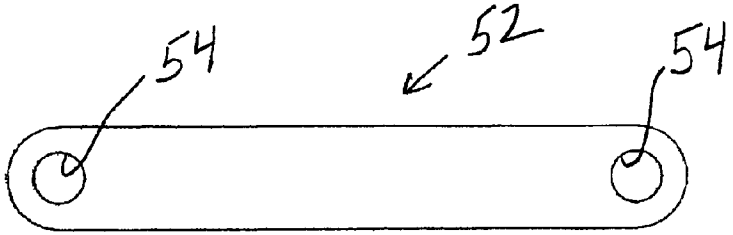
FIG. 24 is a plan view of the frame beam connector.
Figure 23:
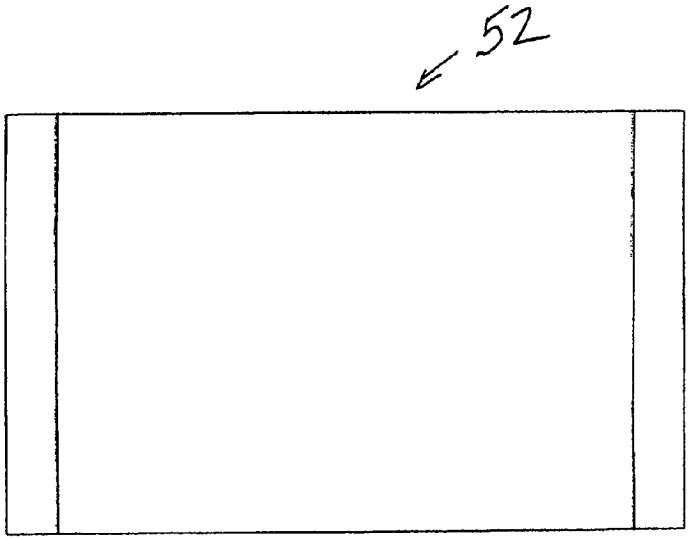
FIG. 23 is a side view of a frame beam connector.

At the ends of a group of frame beams 24, the apertures 40 are not needed for attachment of another frame beam. Referring to FIG. 16, there is shown schematically the attachment of an elongate vertical railing post 110 at one of these ends for a hand rail for perimeter protection, the hooks 112 being for the running of cables or lines between posts 110. The post 110 may be attached in any suitable way, for example, by supporting locking mechanisms which contain bolts or tongues or pins, illustrated at 111, which are suitably caused to lockingly pop into the apertures 40 in a manner commonly known to those of ordinary skill in the art to which the present invention pertains.

It is important to prevent metal-on-metal rubbing contact during needed rotation where the pins 56 are used to join members. Referring to FIG. 26, wherein a pin 56 is shown received in apertures 40 and 54 of a frame beam 24 and connector 52 respectively, four identical washers or grommets 114 composed of Teflon polymer are received to prevent such contact. Each of the washers 114 has a tubular portion 116 and a flat portion 118 extending laterally and radially outwardly from one end thereof. At the upper end, the flat portions 118 of two washers 114 are received between the upper end surface of the connector 52 and the lower surface of the lower flange 32, the tubular portion of the upper of the two upper washers 114 extends upwardly and is received between the pin 56 and the wall of the aperture 40, and the tubular portion of the lower of the two upper washers 114 extends downwardly and is received between the pin 56 and the wall of the aperture 54. The two lower washers 114 are similarly positioned, as shown in FIG. 26. The provision of the washers 114 leaves a gap, illustrated at 120, over most of the height of the aperture 54 between the ends, illustrated at 122, of the lower of the upper washers 114 and the upper of the lower washers 114. As a result, there is virtually no rubbing contact between metal components, the pins 56 desirably touching only Teflon polymer material. The washers 114 are sized so that the tubular portion 116 of the upper one of the washers 114 has a terminal upper end portion 126 which extends slightly above the upper flange 32, for example, about 1/16 inch, so as to prevent rubbing contact with the flange 32 by the pin cap 58. These washers 114 may be glued in place. These washers are not depicted in FIG. 14. Similar washers of Teflon polymer are used similarly in connecting the deck support beams 26 to the frame beams 24. The washers 114 may be made of other suitable polymer or other materials which provide reduced friction contact for easier movements while preventing undesirable metal-to-metal contact.

Regulations in some countries may require the handling of a component by two persons if its weight exceeds, for example, 55 pounds. In accordance with the present invention, in order that two persons not be required (by government regulation or otherwise) to handle any component so as to reduce the amount of manpower needed to erect the platform 20, each of the components is sized and made of a material so that it weighs less than about 50 pounds. Thus, the heaviest of the components in the platform 20 as described herein, which is a plywood panel 30, is sized to weigh less, than 50 pounds, and the remaining components are sized and made of a material to also weigh less than 50 pounds. As discussed herein, aluminum is the material of which most of the components is made, aluminum having a density of about 0.1 pounds per cubic inch, as compared to steel having a density of about 0.28 pounds per cubic inch. Thus, the substantially lesser density of aluminum desirably allows the achievement of the component weight of less than 50 pounds for all components of the platform 20.

Thus, in accordance with the present invention, the lightweight components of the modular platform 20, allowing one person to be able to carry the heaviest component, may be connected together easily and safely and quickly without the need for cranes or other heavy equipment and while allowing flexibility for erecting around obstacles and in tight areas.

Most of the major parts (including the frame beams 24, the deck support beams 26, frame beam connector blocks 52, and shackle blocks) are advantageously extruded from aluminum or other suitable light-weight material, and the deck support beam connector blocks 48 advantageously machined from the frame beam connector blocks 52, thus desirably providing ease of manufacture with little or no welding, thereby further allowing more uniform preciseness for ease of assembly.

It should be understood that, while the present invention has been described in detail herein, the invention can be embodied otherwise without departing from the principles thereof, and such other embodiments are meant to come within the scope of the present invention as defined by the appended claims.

What is claimed is:

1. A platform composed of a combination of parts including frame beams, blocks, and pins which can be assembled and disassembled to erect and dismantle the platform, wherein said frame beams each has an upper flange and a lower flange and said frame beams lie in an end-to-end relation whereby an end portion of one of said frame beams is adjacent an end portion of an other of said frame beams, wherein a pair of said blocks are each removably received between said upper and lower flanges of both said end portion of said one frame beam and said end portion of said other frame beam for connecting said frame beams in the end-to-end relation, each of said blocks having a pair of bores, each of said frame beam end portions having a pair of apertures in said upper flange and a pair of apertures in said lower flange, a first of said pins removably received in one of said pair of bores in each of said blocks and in corresponding ones of said apertures in said upper and lower flanges of said one frame beam, a second of said pins removably received in an other of said pair of bores in each of said blocks and in corresponding ones of said apertures in said upper and lower flanges of said other frame beam thereby connecting said pair of blocks to said one and said other frame beams, whereby, when only one of said blocks connects said one and said other frame beams, said other frame beam is swingable relative to said one frame beam from a position in which said one and said other frame beams are substantially side-by-side to the end-to-end position and whereby said one and said other frame beams are retainable in the end-to-end position when said one and said other frame beams are connected with both of said pair of blocks.

2. A platform according to claim 1 wherein the combination of parts further comprises a plurality of deck support beams, a plurality of deck support beam connector members for connecting said deck support beams to said frame beams to extend normal thereto, each said frame beam having a plurality of apertures equally spaced over a length thereof for receiving pins for attaching said deck support beam connector members thereto to thereby allow attachment of said deck support beam connector members at various locations over the length of said respective frame beam.

3. A platform according to claim 1 wherein the combination of parts further comprises a plurality of deck support beams for interconnecting said frame beams, a plurality of panels, a first plurality of panel connectors for connecting edges of said panels to said deck support beams, and a second plurality of panel connectors for connecting edges of said panels to said deck support beams, each of said first and second panel connectors having a first slot for receiving an edge portion of one of said panels, each of said first panel connectors having a second slot for receiving a flange of one of said deck support beams, and each of said second panel connectors having a third slot for receiving a flange of one of said deck support beams wherein said second panel connector includes a spring-loaded bolt which partially defines said third slot and which is movable to allow an edge portion of said respective panel to be received in said third slot and which is biased to maintain said respective panel edge portion in said third slot.

4. A combination according to claim 3 wherein a lower surface of said first slot is positioned relative to an upper surface of either of said second and third slots to allow a panel to be positioned to overlie a deck support beam.

5. A platform according to claim 1 wherein each of the parts weighs less than about 50 pounds.

6. A combination of parts for constructing a platform, the combination comprising a plurality of frame beams, a plurality of frame beam connector members for connecting said frame beams in an end-to-end relation, said frame beams and said frame beam connector members are adapted for connecting to each end of said frame beams a pair of said frame beam connector members such that one of said pair of said frame beam connector members is connectable to a pair of said frame beams when said pair of said frame beams are disposed substantially in a side-by-side relation and, while said one of said pair of said frame beam connector members is connected to said pair of said frame beams, one of said pair of said frame beams is swingable into a co-axial relation relative to an other of said pair of said frame beams, and such that an other of said pair of said frame beam connection members is connectable to said pair of said frame beams when said pair of said frame beams is in the co-axial relation to maintain said pair of said frame beams in the co-axial relation, wherein said frame beams are I-beams having a pair of flanges connected by a web, wherein said frame beam connector members are in the form of blocks which are sized to be received between said flanges, each of said frame beam connector members has a pair of bores extending therethrough, said flanges having apertures therein on both sides of said web and adjacent each end of said respective frame beam, wherein said connector member bores are spaced to be alignable respectively with said flange apertures on one side of said web in one end portion of one of said frame beams and with said flange apertures on one side of said web in one end portion of an other of said frame beams when said other frame beam is laid generally end-to-end with said one frame beam, and the combination further comprising pins removably receivable in said bores and said respective apertures for connecting said frame beam connector members to said frame beams.

7. A combination according to claim 6 wherein said apertures are spaced from said respective ends of said respective frame beams a distance which allows a gap between said respective frame beams when connected in the co-axial relation, the combination further comprising a plurality of elastomeric members insertable in the gaps to plug the gaps respectively and having cap portions sized to cover said pins respectively.

8. A combination according to claim 6 wherein each of the parts weighs less than about 50 pounds.

9. A combination according to claim 6 further comprising a plurality of deck support beams each for extending between and connecting a pair of parallel ones of said frame beams, and a plurality of deck support beam connector members for connecting said deck support beams to said frame beams in a manner to allow one of said deck support beams to be connected to a one of said frame beams while said one of said deck support beams is in a substantially side-by-side relation with said a one of said frame beams and to allow said one of said deck support beams while connected to said a one of said frame beams to be rotated into a position normal to said a one of said frame beams.

10. A combination according to claim 6 wherein said pins are sized for also connecting said deck support beam connector members to said deck support beams respectively.

11. A combination according to claim 10 further comprising a plurality of identical non-metallic bearing members each having a cylindrical portion for receiving said respective pin and a flat portion for engaging a respective surface of any of said frame beam connector members, said frame beams, said deck support beam connector members, and said deck support beams for preventing metal-to-metal contact by said pins.

12. A combination according to claim 11 wherein said bearing members are composed of a polymer material.

13. A combination according to claim 11 wherein said deck support beams each have flanges which have apertures and said deck support beam connector members each has a bore, wherein said pins are receivable in said respective apertures of said frame beams and said deck support beams and said respective bores of said frame beam connector members and said deck support beam connector members and have heads, and wherein said cylindrical portions of said bearing members have a length which is greater than a thickness of said flanges of said frame beams and said deck support beams respectively whereby to avoid metal-to-metal contact between said heads of said pins and said flanges of said frame beams and said deck support beams respectively.

14. A combination according to claim 9 wherein each of said flanges of each said frame beam has a plurality of apertures spaced along the length thereof respectively and wherein each said deck support beam connector member comprises a first portion sized to be received between said flanges and having a bore extending therethrough, the combination further comprising a plurality of pins receivable in said plurality of apertures and said bore respectively to permit rotatable movement of said deck support beam connector members about said pins respectively.

15. A combination according to claim 14 wherein said deck support beams each has a pair of flanges and a web portion connecting said flanges, each said deck support beam connector member further comprises a pair of second portions between which said web portion is receivable, and the combination further comprising a plurality of fasteners for connecting said second portions to said web portion.

16. A combination according to claim 9 wherein each of said frame beams and each of said deck support beams is composed of aluminum.

17. A method of erecting a platform comprising the steps of:

(a) inserting a first of a plurality of blocks between upper and lower flanges in an end portion of each of both of a pair of frame beams, inserting a first pin in a first bore in the first block and in apertures in the upper and lower flanges of a first of the pair of frame beams, and inserting a second pin in a second bore in the first block and in apertures in the upper and lower flanges of a second of the pair of frame beams thereby connecting the pair of frame beams, while the pair of frame beams are in substantially a side-by-side relation;

(b) swinging the second of the pair of frame beams relative to the first of the pair of frame beams to a co-axial position of the pair of frame beams relative to each other; and (c) inserting a second of the blocks between the upper and lower flanges in the end portion of each of both of the pair of frame beams while the pair of frame beams are in the co-axial position, inserting a third pin in a bore in the second block and in other apertures in the upper and lower flanges of the first of the pair of frame beams, and inserting a fourth pin in an other bore in the second block and in other apertures in the upper and lower flanges of the second of the pair of frame beams thereby to maintain the pair of frame beams in the co-axial position.

18. A method according to claim 17 further comprising connecting a deck support beam to one of the frame beams while the deck support beam is in substantially a side-by-side relation therewith; swinging the deck support beam to a position normal to the one of the frame beams; and connecting the deck support beam to an other of the frame beams.

19. A method according to claim 17 further comprising inserting a portion of a block to which a deck support beam is attached between the upper and lower flanges of one of the frame beams intermediate ends thereof while the deck support beam is in substantially a side-by-side relation therewith; inserting a fifth pin in a first bore in the deck support beam block and in corresponding apertures in the upper and lower flanges of the one frame beam; swinging the deck support beam to a position normal to the one frame beam; and connecting the deck support beam to an other of the frame beams.

20. A method according to claim 17 further comprising selecting the frame beams, blocks, and pins to each weigh less than about 50 pounds.

* * * * *